US005179815A

United States Patent [19]

Cahill et al.

[11] Patent Number: 5,179,815

[45] Date of Patent: Jan. 19, 1993

[54] ARTICLE WRAPPING APPARATUS

[75] Inventors: Michael J. Cahill; Jeffrey J. Patchett; David R. Seaward; Graham L. Shirley; Geoffrey W. Vernon, all of Coventry, England

[73] Assignee: Molins PLC

[21] Appl. No.: 656,677

[22] Filed: Feb. 19, 1991

[30] Foreign Application Priority Data

Feb. 17, 1990 [GB] United Kingdom ..... 9003675
Nov. 28, 1990 [GB] United Kingdom ..... 9025906

[51] Int. Cl.[5] ..... B65B 11/06; B65B 41/02; B65B 61/18

[52] U.S. Cl. ..... 53/133.3; 53/228; 53/389.2; 53/389.3

[58] Field of Search ..... 53/133.5, 228, 229, 53/230, 389.1, 389.2, 389.3, 389.5, 231, 133.3, 232, 233, 586

[56] References Cited

U.S. PATENT DOCUMENTS 2,107,482 2/1938 Kemp ..... 53/230
3,383,832 5/1968 Grant et al. ..... 53/230 X
3,849,969 11/1974 Paules ..... 53/389.5 X
4,090,912 5/1978 Davies et al. .
4,217,744 8/1980 Mizutani ..... 53/389.3 X
4,385,479 5/1983 Focke ..... 53/228 X
4,541,225 9/1985 Byland ..... 53/228 X
4,620,409 11/1986 McElvy ..... 53/389.5 X
4,719,575 1/1988 Gnuechtel .

FOREIGN PATENT DOCUMENTS 2213456 8/1989 United Kingdom .

*Primary Examiner*—John Sipos
*Assistant Examiner*—Linda B. Johnson
*Attorney, Agent, or Firm*—Antonelli, Terry, Stout & Kraus

[57] ABSTRACT

Article wrapping apparatus, particularly for wrapping cigarette packets in wrapper film, includes separate cutters (34A,14) respectively for severing a wrapper web into separate sections and for cutting the leading end of a tear strip attached to each section. Drive means (24) is provided for varying the path length of the web between the cutters. Separate drives (12,30) are provided respectively for the cutters and for the web, these being synchronized with a further separate drive for the articles. An air mover (32) assists feeding of the web towards the main cutter (34A); a further air mover (50) assists feeding of wrapper sections across and beyond the path of an article to be wrapped. Opposed belt conveyors (43,44) may be clamped together under action of air cylinders for feeding of wrapper sections without loss of timing.

24 Claims, 5 Drawing Sheets

ARTICLE WRAPPING APPARATUS

Figure 1:
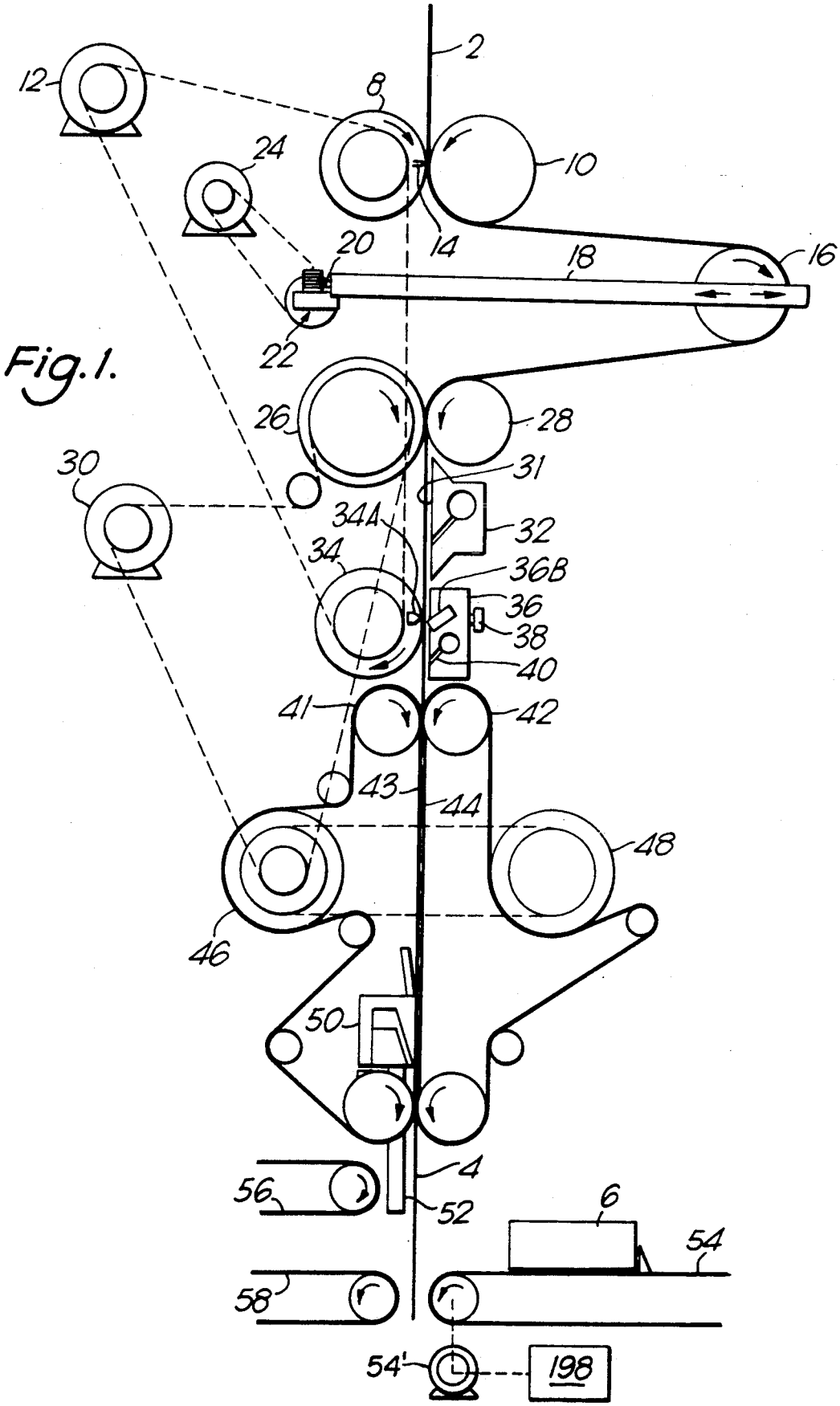

This invention relates to article wrapping apparatus, and in particular to such apparatus including means for feeding and severing a web of wrapper material so as to produce wrapper sections for wrapping articles.

In the tobacco industry it is common to wrap and seal cigarette packets in transparent film wrapper material. Wrapper sections of such material are usually severed from a continuous web. Commonly the web carries a longitudinally extending tear strip provided to facilitate unwrapping of the wrapped packet by the consumer. It is known to sever a part of the strip (and, usually, the underlying wrapper) prior to application of each wrapper section to a packet: the severed leading end thus provides a convenient part of the strip to be grasped and pulled by the consumer. The present invention is particularly, but not exclusively, applicable to wrapping of packets having this form of wrapper section.

According to a one aspect of the invention article wrapping apparatus includes means for feeding a wrapper web along a path, first severing means at a first position on the path for performing a first severing operation on the web, second severing means at a second position on the path for performing a second severing operation on the web, said second severing operation facilitating division of the leading end of the web into successive separate wrapper sections, means for conveying articles in series, means for conveying successive wrapper sections to a position at which they are intercepted by successive articles delivered by said article conveying means so as to become at least partially wrapped around the leading portions of said articles, and means for varying the path length of the web between said first and second positions so as to control the relative positions on the web of said first and second severing operations. Preferably the apparatus includes means for changing the lengths of successive sections severed from the web. The changing means may include means for varying the frequency of operation of said second severing means and/or the speed of said web feeding means, so as to alter the spacing between cuts in the web.

In a preferred arrangement the path length is varied so that it remains an integral multiple of the lengths of said wrapper sections. The path length varying means may include means for moving the position of guide means, e.g. an idler roll, around which the web passes between the first and second severing means. In a preferred arrangement movement of the guide means is achieved by drive means, which may be controlled by a microprocessor.

The apparatus may form part of a wrapping machine for wrapping film material around successive spaced cigarette packets fed in line. The first severing means may comprise a rotary cutter for severing the web, e.g. in the vicinity of a longitudinally extending tear strip adhesively applied to the web upstream of the apparatus. In a particularly preferred arrangement of the apparatus the second severing means also comprises a rotary cutter which severs the web (and tear strip) into sections. The first cutter is preferably upstream of the second cutter.

The first and second severing means preferably have common drive means which is preferably separate from drive means for the web feeding means. Preferably the respective drive means comprise separate motors, the speeds of which are electronically controlled. The speeds of said motors may be under overall control of a microprocessor, so that if it is desired to change the lengths of wrapper sections severed from the web, for example, this may be achieved by appropriate software commands to alter the relative speeds of the respective drive means. A preferred way of achieving this is to use software to define rotational positions of the motors at set times. The means for varying the path length may also be under common control of the microprocessor or other software system. This is particularly convenient where the apparatus is required from time to time to produce separate wrapper sections of different lengths, since producing sections of different lengths (e.g. for different sizes of packets) may then be achieved entirely by software commands. Thus, in effect the apparatus may provide a programmable, substantially immediate, size change facility.

Either of said severing operations, particularly said first severing operation, could comprise a partial severing operation, e.g. production of a line of perforations or other weakening of the web.

According to another aspect of the invention article wrapping apparatus includes a wrapper web conveying means, means for severing the web into separate sections, and means for conveying said sections towards a position at which they are intercepted by an article around which they will subsequently be wrapped, and air mover means upstream of the severing means for feeding the web towards the severing means. It is known to feed web material to a cutter between opposed guide surfaces utilising air flow produced by a venturi effect between the guide surfaces but we have found that an improvement is achieved (i.e. higher web speeds are possible) if an air mover, in which an air stream follows a guide surface by Coanda effect, acting on one side only of the web path is used. In a preferred arrangement a further air mover is arranged downstream of the severing means for feeding the severed sections towards the article path.

According to a further aspect of the invention article wrapping apparatus includes wrapper web conveying means, means for severing the web into separate sections, means for conveying articles to be wrapped along a path, means for conveying said wrapper sections towards a position at which they are intercepted by an article on said path and so that they become draped around said article, and an air mover for directing a stream of air along a guide surface extending adjacent said path. Thus the guide surface associated with the air mover may extend right up to the article path, and may extend beyond the article path so that an air stream generated by the air mover may assist conveyance of a wrapper section across the article path prior to interception by an article. The absence of any moving mechanical conveyor (e.g. belt conveyors) extending across the article path allows extension of a conveyor for the articles across the line of conveyance of the wrapper sections, thereby retaining positive control for advancement of the articles beyond the position at which they intercept a wrapper section.

Preferably an air mover is located beyond the article path in relation to the direction of the feed of the wrapper sections. In this case the leading end of each wrapper section may extend into a channel defined between opposed guide surfaces prior to interception of each section by an article, said air stream extending into said channel. A guide surface may extend from a position located on an upstream side of the article path relative to the direction of travel of the wrapper sections and may have an aperture or window through which articles may pass. The guide surface is preferably continuous at its sides to provide guidance for an air stream and/or the sides of each wrapper section as it passes the aperture or article path.

Where the article path is generally horizontal with wrapper sections being conveyed downwards across the path for example, air movers could be provided just above and just below the article path, the guide surface being preferably common to both air movers. In a preferred arrangement a guide plate having an aperture for passage of articles cooperates with an opposed air mover beyond the article path. Preferably the guide plate is located upstream of the path of wrapper sections relative to the direction of movement of the articles. The guide plate may have an associated air mover for generating an air stream across and/or along the sides of the aperture.

According to a still further aspect of the invention article wrapping apparatus includes means for conveying wrapper sections towards an article path at which successive sections are intercepted by an article, including opposed belt conveyors for feeding wrapper sections towards said path and means extending along at least one of said conveyors for urging said conveyors together to clamp wrapper sections during conveyance. Said urging means may comprise a movably supported backing plate for the other conveyor, and air cylinder means for urging the movable plate towards the stationary plate. Clamping of wrapper sections helps to ensure retention of relative timing after severing. Sensors may be provided to detect each wrapper section as it is conveyed by said conveying means and may be connected to control means for compensating for any drift in position of wrapper sections: such compensation would normally be achieved by slight speed adjustments of the conveying means (relative to the article conveying means).

The different aspects of this invention may be used in any combination, e.g. so that they are embodied in the same apparatus.

Figure 2:
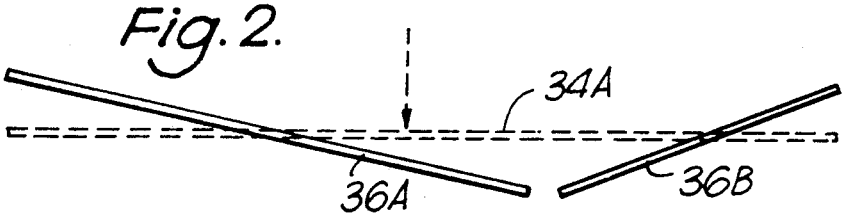
Figure 3:
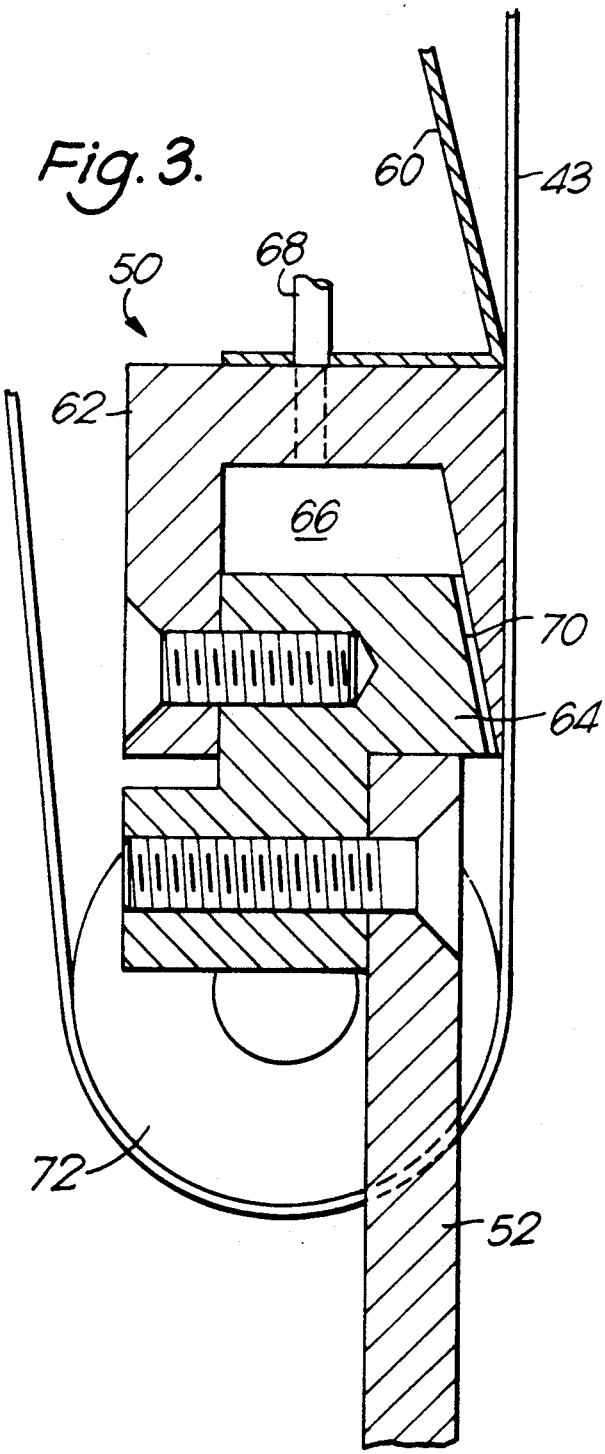
Figure 4:
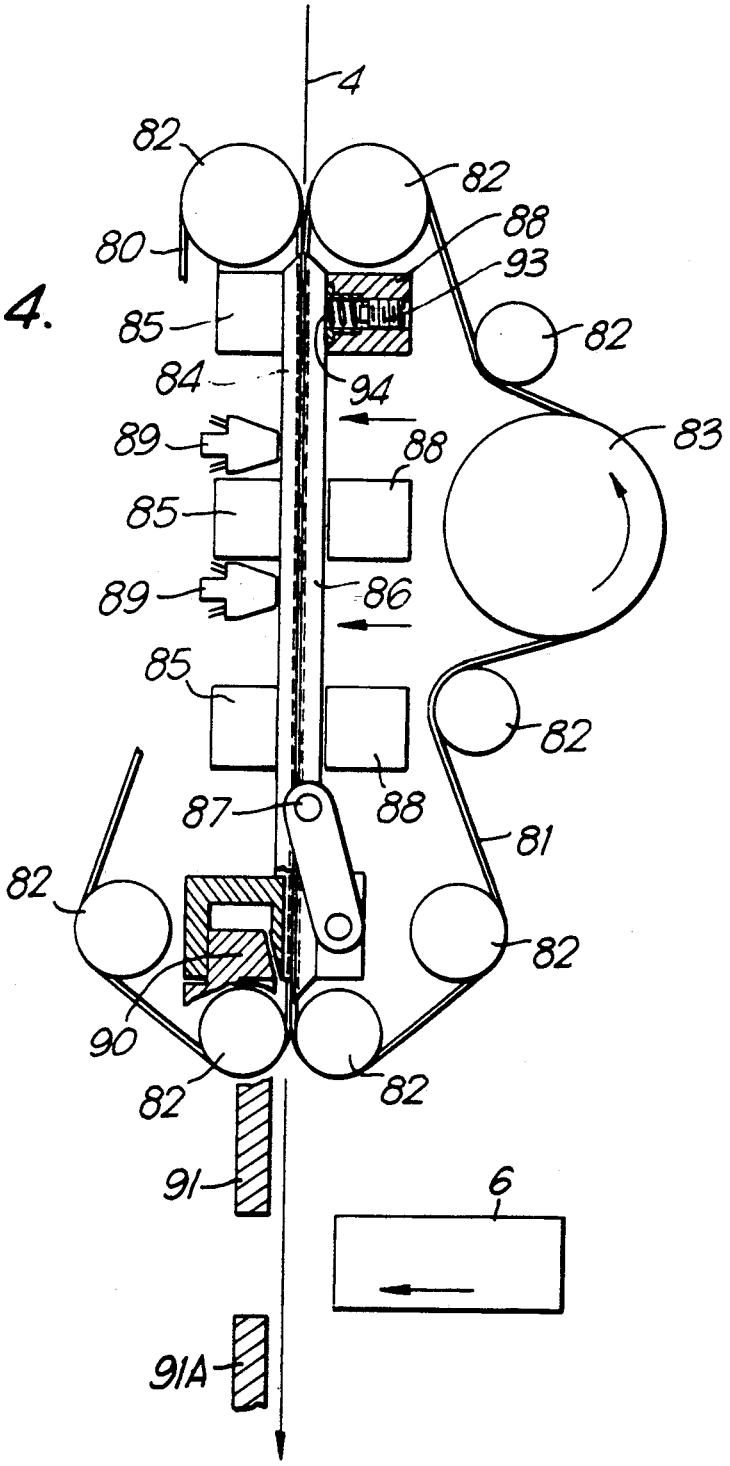
Figure 5:
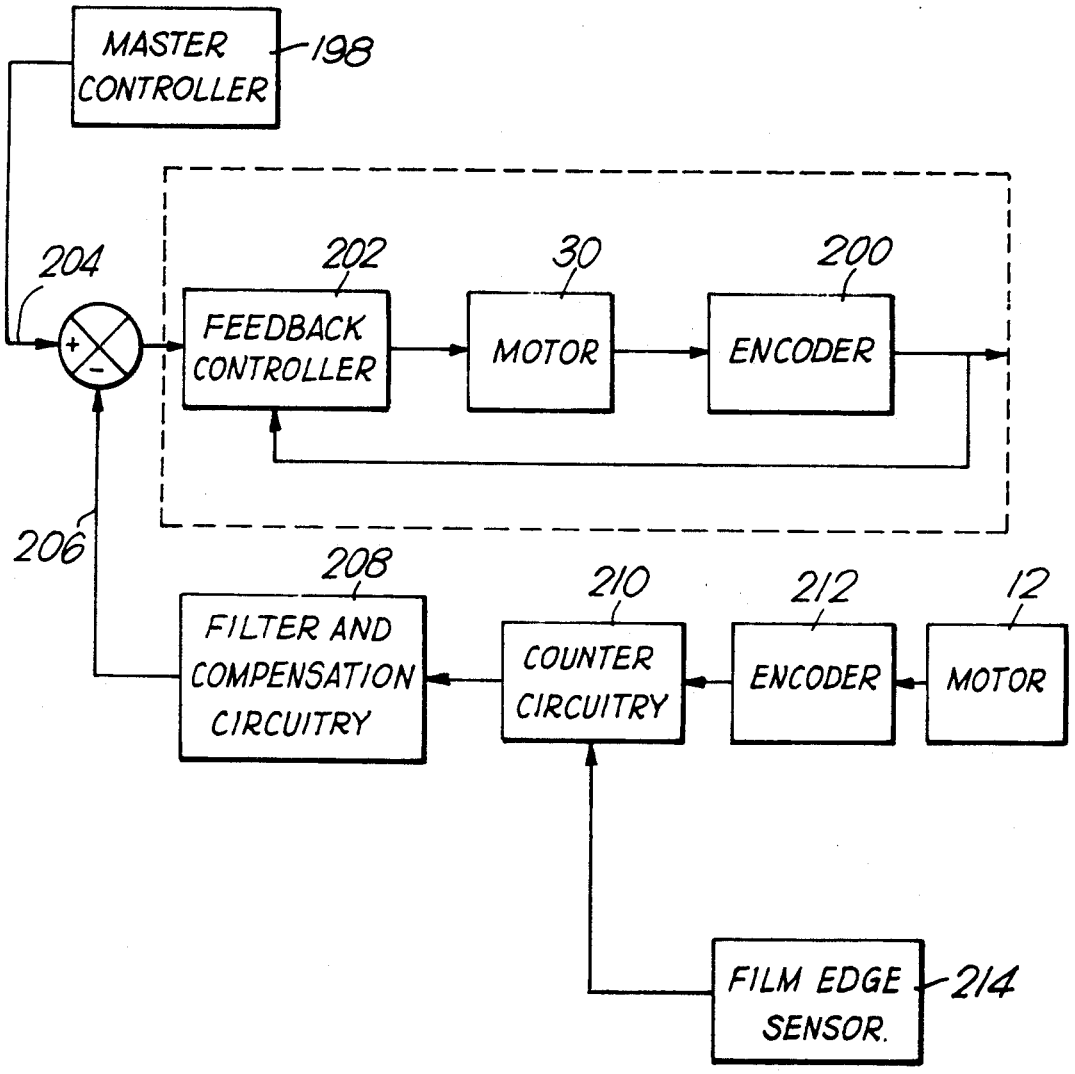
Figure 7:
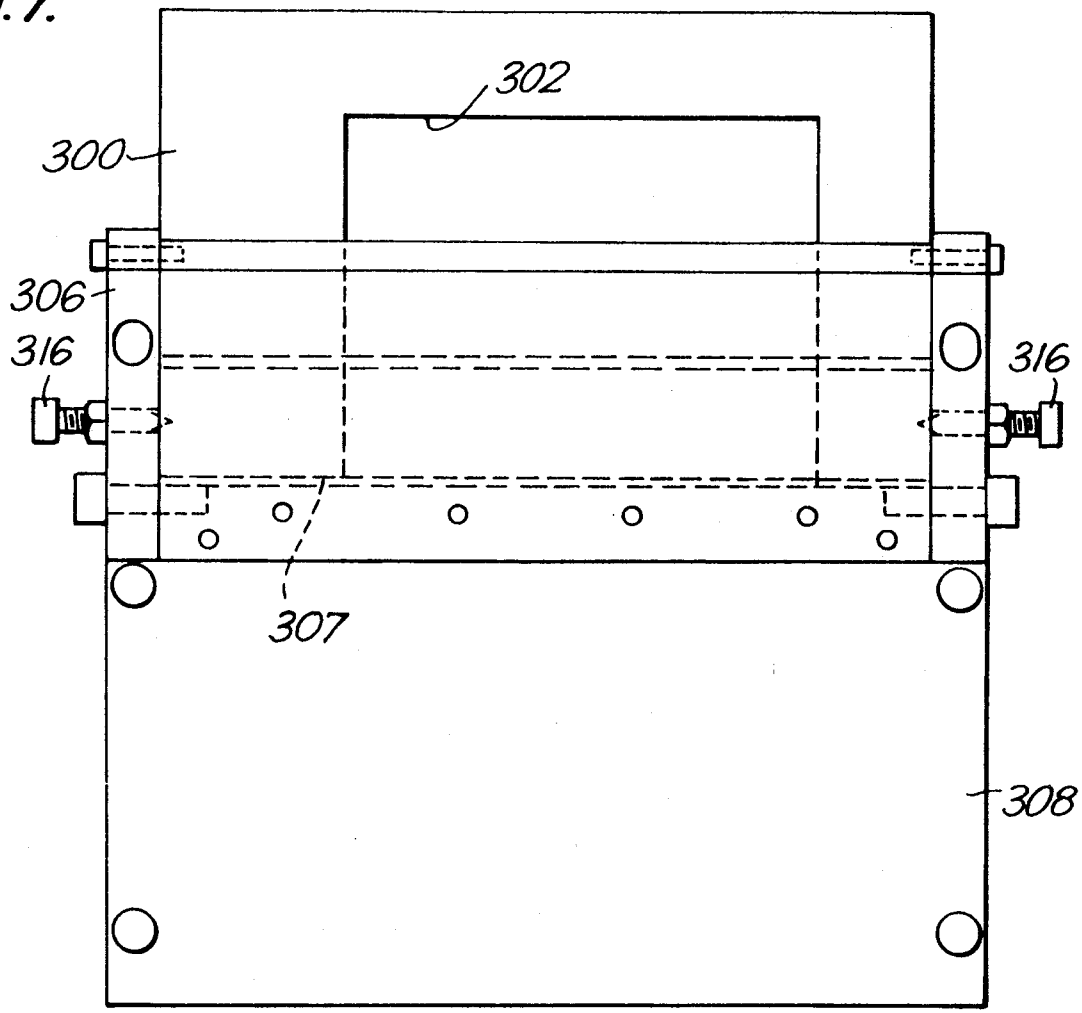
Figure 6:
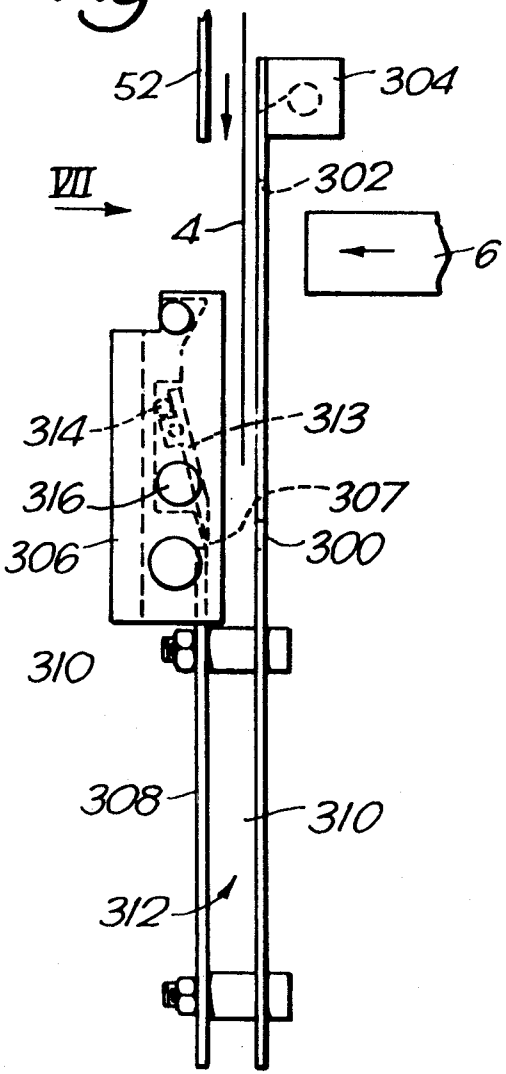

The invention will be further described, by way of example only, with reference to the accompanying diagrammatic drawings, in which:

FIG. 1 is a side view of web feeding and severing apparatus,

FIG. 2 is an enlarged front view of a detail of part of the apparatus of FIG. 1, FIG. 3 is an enlarged sectional view of an air mover usable with the apparatus of FIG. 1, FIG. 4 is a part-sectional side view of part of a modified web feeding and severing apparatus, and FIG. 5 is a schematic block diagram of a part of a control arrangement for the apparatus of FIG. 1, FIG. 6 is a side view of part of another modified web feed and severing apparatus, and FIG. 7 is a view in the direction of arrow VII in FIG. 6.

FIG. 1 shows apparatus for feeding and severing a web 2 of transparent film and for feeding successive severed sections 4 of the web into the path of a packet 6. The apparatus forms part of a machine for wrapping in transparent film about cigarette packets 6 delivered in line from a cigarette packing machine.

The web 2 is a composite web, having a longitudinally-extending tear strip adhesively secured to it in conventional manner, and is delivered at a controlled speed to a nip between rolls 8 and 10. The roll 8 is driven by a motor 12 and carries a cutter 14 which severs the web 2 only in the vicinity of the applied tear strip, so as to produce successive severed leading ends of the tear strip (for ease of unwrapping the final wrapped packets).

From the roll 10 the web 2 passes around an idler roll 16, the position of which is movable along a track 18. In order to allow variation of the position of the roll 16, the track 18 supports a longitudinally extending threaded shaft 20 carrying a captive nut (not shown) movable with the mounting for the roll. Rotation of the shaft 20 by means of a transmission 22 and motor 24 thus causes movement of the axis of roll 16 along the track 18.

The web 2 passes from the idler roll 16 to the nip between a main drive roll 26 and a cooperating rubber roll 28. The drive roll 26 is driven by a motor 30. Beyond the rolls 26, 28 the web 2 passes across the face 31 of an air mover 32 and subsequently passes between a rotary cutter 34 and a cooperating stationary cutter unit 36. The rotary cutter 34 is driven by the motor 12 which drives the roll 8 carrying the tear strip cutter 14. As best shown in FIG. 2, the cutter unit 36 has stationary inclined blades 36A and 36B separated by a gap (which corresponds to the position of the tear strip on the web 2), which cooperate with a single transverse blade 34A carried by the cutter 34. The blades 36A and 36B are adjustable relative to the blade 34A, by means indicated at 38 in FIG. 1, so as to ensure the required contact (or spacing) between the respective blades.

The stationary cutter unit 36 includes an integral air mover 40, downstream of the blades 36A and 36B, for directing the sections 4, now severed from the web 2, to a nip between opposed pairs of laterally spaced pinch rolls 41, 42 around which respectively pass opposed pairs of laterally spaced timing belts 43, 44. Each of the pairs of belts 43. 44 passes around respective drive pulleys 46, 48, which are driven by the motor 30. A further air mover 50 is arranged between the laterally spaced belts 43, near their downstream ends, and includes a guide surface 52 which extends down to a position just above the path of the packet 6.

Successive packets 6 are conveyed at regular spacing by a pusher conveyor 54 driven by a motor 54'. Each packet 6 is intercepted by a wrapper section 4 and the packet and wrapper section are conveyed by upper and lower conveyors 56, 58 into a folding and sealing section of the wrapping machine, in which the wrapper section is folded and sealed around the packet.

It will be noted that the roll 8 and cutter 34 are driven by the same motor (12). Cutting of the tear strip by the cutter 14 and severing of the web 2 by the blade 34A (cooperating with blades 36A and 36B) are therefore subject to similar control by control of motor 12. In this respect the speed of motor 12 is variable during a cutting cycle and controlled such that the speeds of the cutter 14 and the blade 34A are the same as that of the web 2 (controlled by motor 30) during actual cutting but variable at other times. By controlling the speed of motor 12 in this way relative to the speed of motor 30 determining the speed of the web 2, it is possible to vary the cycle times of the cutter 14 and blade 34A independently of the speed of the motor 30, and thereby vary the lengths of wrapper sections 4 produced by the apparatus.

Normally it is required that each wrapper section 4 should have a single tear strip cut positioned in the same place relative to the length of the section. In order to achieve this for different possible lengths of the section 4 the path length of the web 2 between the cutters 14 and 34 is adjustable, by varying the position of the idler roll 16, so as to be equal to an integral number of wrapper section lengths.

Since the position of idler roll 16 is controllable by motor 24, and the speed of cutters 14 and 34 is similarly controllable by motor 12, changes in length of wrapper sections 4 can be controlled automatically by appropriate commands to motors 12 and 24. This is conveniently achieved by arranging for motors 12 and 24 (and 30) to be under control of one or more microprocessors (which may conveniently be incorporated in a master controller 198).

The air mover 32, downstream of driving rolls 26, 28 produces a stream of air closely following the face 31 of the air mover (due to Coanda effect) so as to guide the web 2 towards the cutter 34. The air stream draws the web 2 towards the face 31 of air mover 32 so that no opposing guide surface is required.

The cutter blades 34A, 36A and 36B sever the web 2 by a shearing action. Conventionally with such arrangements initial severing starts at one side of the web and progresses towards the other side. Experience has shown that this can result in misalignment or skewing of the subsequently-produced wrapper sections due to release of one side of the section before the other side. As seen in FIG. 2, in the present arrangement the blade 34A makes approximately simultaneous contact with the outer parts of the blades 36A and 36B so that two simultaneous shearing actions moving inwards relative to the web 2 are performed. Any asymmetric forces acting on the severed wrapper sections 4 are therefore substantially reduced. Although from the point of view of reducing these forces even further it might be preferable for the blades 36A and 36B to be similarly inclined and for the gap (if any) between them to be centrally located relative to the web 2, it is preferred that the blades extend to opposite sides of a gap the position of which is dictated by the location of the tear strip (and it is normal for this to be positioned off-centre). As an alternative arrangement, in which asymmetric forces are substantially eliminated, the blades 36A and 36B could be of substantially equal length (and inclination) with a short discontinuity in the blades 36B corresponding to the position of the longitudinal tear strip.

Downstream of the cutter 34 the severed wrapper sections 4 are guided by air mover 40 towards the pinch rolls 41, 42 of timing belts 43, 44. The belts 43. 44 move at a higher peripheral speed that the web 2 so that the wrapper sections 4 are spaced apart by the belts. In order to ensure adequate contact with the wrapper sections 4 downstream of the pinch rolls 41, 42 the belts 43, 44 may be lightly urged together (e.g. by an arrangement similar to that described below with reference to FIG. 4).

The air mover 50 directs a stream of air along the surface 52 and this assists conveyance of the leading end of each wrapper section 4 across the path of a packet 6. The spacing of packets 6 on the conveyor 54 and the timing and speed of this conveyor relative to the timing and speed of motors 12 and 30 causes each wrapper section 4 to he centrally intercepted by the leading side of a packet 6. Note that by use of the air mover 50 and guide 52 it is unnecessary for each wrapper section 4 to be guided across the path of the packet 6 (as with some conventional arrangements where laterally spaced vacuum bands extend across this path). Since there is no downwardly extending guide for the wrapper sections 4, it is possible for the pusher conveyor 54 to comprise laterally spaced belts with pushers extending between them and for the conveyor 54 to extend beyond the path of the wrapper sections 4 so that each pusher controls the packet up to and through the path of the wrapper sections 4. Clearly, in that case the end pulley of the conveyor 58 could, if necessary, be moved to the left from its position shown in FIG. 1.

In one form of apparatus similar to that shown in FIG. 1 the spacing of pushers on the conveyor 54 is 120 millimeters and the length of each wrapper section is adjustable between 121 and 221 millimeters. At 650 packets per minute the speed of conveyor 54 is 1.3 meters/second that of belts 43, 44 is 5.3 meters/second and that of web 2 is 1.8 meters/second.

FIG. 3 shows in more detail the construction of the air mover 50, including a lead-in guide 60, main housing 62, insert 64 and guide 52. The housing 62 and insert 64 define an air chamber 66, to which leads an air supply pipe 68. The housing 62 and insert 64 have cooperating internal inclined faces, one of which includes laterally spaced recesses 70 defining air outlet passages for directing air across and along the guide 52. FIG. 3 also shows an end pulley 72 for one of the laterally spaced belts 43.

FIG. 4 shows a modified arrangement for feeding wrapper sections 4 from the cutter 34 to the path of packets 6. Laterally spaced timing belts 80. 81 pass around various idler rolls 82 and around drive pulleys 83 (only one of which is shown in FIG. 6). The belts 80 pass over a fixed UHMW polyethylene guide 84 supported by mounting blocks 85. The belts 81 pass over a similar UHMW polyethylene guide 86, which is movably supported by a load-bearing pivot link 87 and spring units 88 which urge the guide 86 towards the guide 84. Each spring unit 88 has a threaded bore containing a compression spring 94 and adjustment screw 93. The belts 80, 81 are thus pressed together so as to grip the wrapper sections 4 as they are conveyed. Note that the upper idler rolls 82 do not grip the wrapper sections 4 (as do the pinch rolls 41, 42).

Wrapper section position sensors 89 which detect the leading (or trailing) edge of each wrapper section 4 by optical (or other conventional) means, are located adjacent the guide 84 (which, for this purpose may comprise laterally spaced sections). The sensors 89 are capable of detecting incorrect timing of a wrapper section 4 relative to a packet 6, incorrect speed (i.e. if a section is slipping relative to the belts 80, 81), or if the wrapper section is skew. For the last purpose at least one of the sensors 89 includes laterally spaced elements.

An air mover 90, which is similar to the air mover 50 is located adjacent to the lower end of the guide 84. A guide surface 91 extends downward from the air mover 90 and, in this case, includes a portion 91A extending beyond the path of the packet 6. The air stream generated across the surface 91 by the air mover 90 helps to ensure correct positioning of the leading edge of the wrapper section: the presence of the section 91A is additionally beneficial in this respect.

FIG. 5 is a schematic block diagram of part of the control arrangement for the apparatus of FIG. 1. A similar control arrangement is usable with the apparatus of FIG. 4. The web feed motor 30 is connected to a shaft encoder 200 which in turn is linked to a feedback controller 202. A first input 204 to the controller 202 derives from a master controller 198 which supplies pulses synchronised with advancement of packets 6 on conveyor 54. This basic signal on line 204 is modified by a signal on line 206 which applies a correction dependent on deviation of the position of a wrapper section 4 from an expected position. The correction is generated by comparing in a filter circuit 208 the value of a count generated by a counter 210 with an expected value, the value being set by the delay between a horizon pulse received from an encoder 212, which pulse corresponds to the instant when motor 12 causes cutter 34 to sever the web 2, and the instant when a film edge sensor 214, corresponding in function and position to sensor 89 in FIG. 4, detects the leading edge of the severed wrapper section 4 between opposed belts 43, 44. Any such deviation results in a correction signal generated by circuit 208 to cause a compensating adjustment of the speed of motor 30.

The apparatus shown in FIGS. 6 and 7 is arranged adjacent the path of a packet 6 in apparatus otherwise similar to that of FIG. 1 or FIG. 4. Thus, the guide plate 52 (or 91) may extend down from the air mover 50 (or 90) as indicated in FIG. 6. A vertical guide plate 300 for the wrapper sections 4 extends from a region above the path of the packets 6 to a region below the path. The plate 300 has an aperture 302 dimensioned to allow passage of packets 6 through the plate. The lower edge of aperture 302 is somewhat lower than the level of the bottom of packets 6 to allow clearance for the end portion of a conveyor (not shown) for the packets. At its upper end the plate 300 carries an air mover 304 which directs a stream of air in a downward direction generally along the plate, so as to assist movement of wrapper sections 4 in the same direction.

The plate 300 extends below the aperture 302 and is opposed by a further air mover 306 having an air outlet 307, which directs a further stream of air downwards between the plate and another guide plate 308, effectively forming an extension of the air mover 306. One side of the air outlet 307 is defined by an edge of a pivotable plate 313. The width of the air outlet 307 can be adjusted by pivoting the plate 313 against a resilient seal 314 by means of taper point screws 316, which have a wedging action on the sides of the plate. The space between the plates 300 and 308 below the air mover 306 is also enclosed by side plates 310, thereby forming a rectangular section channel 312 for air directed primarily by the air mover 306.

In use, the air mover 304 may supplement or assist the air flow from the air mover 50 (or 90) in conveying the leading end of each wrapper section 4 across the path of the packets 6. The air flow generally follows the plate 300, which therefore effectively acts as a guide for the wrapper sections 4. Note that the aperture 302 is narrower than the width of the wrapper sections 4 so that at least at the sides each wrapper section is adjacent a continuous guide surface as it descends past and beyond the path of the packets 6. The air mover 306 provides a continuing stream of air principally channelled between the guide plates 300 and 308 in the channel section 312, into which the lower end of each wrapper section 4 descends just before its central portion is intercepted by a packet 6. Subjecting the leading end of the wrapper section 4 to a continuing conveying force helps to maintain the section flat and under control, thereby promoting a good initial wrap of the packet following interception of the section.

We claim:

1. Article wrapping apparatus, comprising:

means for feeding a wrapper web along a path;

first severing means at a first position on the path for performing a first severing operation on the web;

second severing means at a second position on the path for performing a second severing operation on the web, said second severing operation facilitating division of the leading end of the web into successive separate wrapper sections;

means for conveying articles in series;

means for conveying said successive wrapper sections to a position at which they are intercepted by successive articles delivered by said article conveying means so as to become at least partially wrapped around the leading portions of said articles; and control means for adjusting the length of a wrapper section including first means for varying the path length of the web between said first and second positions so as to control the relative positions on the web of said first and second severing operations and second means for adjusting the frequency of said second severing operation on the web so that predetermined lengths of wrapper section are produced.

2. Apparatus as claimed in claim 1, wherein said control means includes further means for altering the speed of said web feeding means.

3. Apparatus as claimed in claim 1, wherein said first means includes means arranged to maintain said path length and the lengths of said wrapper sections in a predetermined relationship.

4. Apparatus as claimed in claim 1, including common drive means for said first and second severing means.

5. Apparatus as claimed in claim 4, wherein said web feeding means and said wrapper section conveying means each include drive means which is separate from said common drive means.

6. Apparatus as claimed in claim 1, wherein the first severing means is upstream of said second severing means and arranged to make a cut in a predetermined position in each wrapper section.

7. Apparatus as claimed in claim 1, wherein the first means comprises means for relocating guide means for the web on said path between said first and second positions.

8. Apparatus as claimed in claim 7, wherein said guide means comprises a rotary guide and said relocating means includes drive means for moving the axis of said rotary guide.

9. Apparatus as claimed in claim 8, including a track along which said axis is movable, said drive means extending along said track.

10. Apparatus as claimed in claim 1, wherein the feeding means includes an air mover adjacent and upstream of said second severing means for detecting pressure air so as to entrain ambient air to assist conveyance of the web along said path.

11. Apparatus as claimed in claim 1, wherein the wrapper section conveying means includes air mover means for detecting pressure air so as to entrain ambient air to assist conveyance of the web along said path.

12. Apparatus as claimed in claim 11, including air mover means in the vicinity of said position at which wrapper sections are intercepted by articles.

13. Apparatus as claimed in claim 12, including an air mover located beyond the position at which wrapper sections are intercepted by said articles, so as to assist conveyance of the leading end of each wrapper section after it has past said position and prior to interception of the wrapper section by the leading end of an article.

14. Apparatus as claimed in claim 1, wherein said means for conveying wrapper sections includes opposed belt conveyors and means extending along at least one of said conveyors for urging the conveyors together to clamp wrapper sections during conveyance.

15. Apparatus as claimed in claim 1, including means for generating a signal on detection of a predetermined portion of a wrapper section conveyed by said wrapper section conveying means, means for processing said signal including means for generating a timing signal, and means for correcting relative positions of wrapper sections by adjusting the speed of said wrapper section conveying means.

16. Apparatus as claimed in claim 1, wherein the second severing means includes a rotary cutter member cooperating with a stationary member to 1 sever the web progressively by a shearing action.

17. Apparatus as claimed in claim 16, wherein said rotary and stationary members are arranged to produce separate progressive cuts moving across the web in substantially opposite directions substantially simultaneously.

18. Apparatus as claimed in claim 1, wherein the wrapper web comprises a main web and a longitudinally extending strip attached to the main web, said first severing means being arranged to sever at least part of said strip.

19. Article wrapping apparatus, comprising means for feeding a wrapper web, first severing means for severing successive leading end portions of the web into wrapper sections of predetermined length, means for conveying articles to be wrapped along a path, means for conveying successive wrapper sections to a position at which they are respectively intercepted by successive articles conveyed along said path and thereby initiating wrapping of the articles, second severing means upstream of said first severing means for performing a separate severing operation on the web so that at least one such operation is performed on each portion of the web corresponding to a wrapper section, means defining a variable length path for the web between said first and second severing means, first drive means for said wrapper section conveying means, second drive means for said article conveying means, third drive means for said first severing means, fourth drive means for said second severing means, fifth drive means for moving said path length defining means to vary the length of said path, and control means for said first, second, third, fourth and fifth drive means, said control means including means for synchronising said drives for operation at a plurality of different predetermined lengths of wrapper sections and means for controlling said fifth drive means to maintain said variable path length in a predetermined relationship with the length of a wrapper section.

20. Apparatus as claimed in claim 19, wherein said third and fourth drive means are driven from a common drive.

21. Apparatus as claimed in claim 19, further including means for generating a timing signal related to passage of a predetermined portion of a wrapper section conveyed by said wrapper section conveying means, and means for generating a timing signal related to passage of a predetermined portion of an article conveyed by said article conveying means, wherein said control means includes means for comparing said timing signals and for making a corrective adjustment to said first drive means relative to said second drive means so that interception of wrapper sections and articles is synchronised.

22. Apparatus as claimed in claim 19, wherein said wrapper web feeding means is connected to said first drive means.

23. Apparatus as claimed in claim 1, wherein said second severing means comprises a rotary cutter positioned adjacent said path, and said second means includes means for controlling the speed of rotation of said rotary cutter so that said speed is the same as that of the web during severing of the web and variable at other times to control the relative frequency of said second severing operation.

24. Apparatus as claimed in claim 23, including common drive means for said first and second severing means.

* * * * *